US012807383B2

(12) United States Patent
Niver

(10) Patent No.: US 12,807,383 B2
(45) Date of Patent: Nov. 24, 2026

(54) CAP WITH KEY LOCK ASSEMBLY

(71) Applicant: Bemis Manufacturing Company, Sheboygan Falls, WI (US)

(72) Inventor: Michael A. Niver, Plymouth, WI (US)

(73) Assignee: Bemis Manufacturing Company, Sheboygan Falls, WI (US)

( * ) Notice: Subject to any disclaimer, the term of this patent is extended or adjusted under 35 U.S.C. 154(b) by 44 days.

(21) Appl. No.: 18/965,534

(22) Filed: Dec. 2, 2024

(65) Prior Publication Data

US 2025/0178806 A1 Jun. 5, 2025

Related U.S. Application Data

(60) Provisional application No. 63/605,356, filed on Dec. 1, 2023.

(51) Int. Cl.
*B65D 55/14* (2006.01)
*B65D 41/04* (2006.01)

(52) U.S. Cl.
CPC ..... *B65D 55/14* (2013.01); *B65D 41/04* (2013.01)

(58) Field of Classification Search
CPC ..... B65D 55/14; B65D 41/04; B60K 2015/03547; B60K 2015/0438; B60K 2015/0451; B60K 15/0409
See application file for complete search history.

(56) References Cited

U.S. PATENT DOCUMENTS

| | | | |
|---|---|---|---|
| 738,917 | A | 9/1903 | Kempien |
| 1,694,030 | A | 12/1928 | Bean |
| 1,702,205 | A | 2/1929 | Freedman |
| 1,702,532 | A | 2/1929 | Boomer et al. |
| 2,070,692 | A | 2/1937 | Stone |
| 2,308,892 | A | 1/1943 | Miller |
| 2,681,559 | A | 6/1954 | Friend |
| 2,696,100 | A | 12/1954 | Nehls |
| 2,816,433 | A | 12/1957 | Friend |
| 2,820,565 | A | 1/1958 | Oberle |
| 3,136,148 | A | 6/1964 | Nehls |

(Continued)

FOREIGN PATENT DOCUMENTS

| | | |
|---|---|---|
| CN | 106183792 B | 7/2018 |
| DE | 4006465 A1 | 9/1991 |

(Continued)

*Primary Examiner* — James N Smalley

(74) *Attorney, Agent, or Firm* — Michael Best & Friedrich LLP

(57) ABSTRACT

A cap includes a body, a handle couplable to the body, and a key lock assembly operable to selectively couple the handle to the body for co-rotation. The key lock assembly includes a lift cam supported within the body and having a first cam surface, a clutch plate supported within the handle and having a second cam surface engageable with the first cam surface, and a key lock cylinder coupled for co-rotation with the lift cam. The key lock cylinder is rotatably coupled to the handle and movable between an unlocked position where the handle is coupled to the body and a locked position where the handle is decoupled from the body. Rotation of the key lock cylinder towards the locked position rotates the lift cam so the first cam surface engages the second cam surface to axially displace the clutch plate to uncouple the handle to the body.

19 Claims, 7 Drawing Sheets

(56) References Cited

U.S. PATENT DOCUMENTS

| | | | | |
|---|---|---|---|---|
| 3,343,697 | A | 9/1967 | Roberts et al. | |
| 3,373,894 | A | 3/1968 | Johnson | |
| 3,426,932 | A | 2/1969 | Rouse | |
| 3,918,602 | A | 11/1975 | McIntosh | |
| 3,945,454 | A | 3/1976 | Kinoshita et al. | |
| 3,950,973 | A | 4/1976 | Grasnianski | |
| 3,982,651 | A * | 9/1976 | Braun | B65D 41/17 220/288 |
| 3,998,078 | A | 12/1976 | Detwiler | |
| 4,000,632 | A | 1/1977 | Summan | |
| 4,000,633 | A | 1/1977 | Evans | |
| 4,013,191 | A | 3/1977 | Gerdes | |
| 4,083,209 | A | 4/1978 | Sloan, Jr. | |
| 4,107,960 | A | 8/1978 | Neiman | |
| 4,107,961 | A | 8/1978 | Evans | |
| 4,132,091 | A | 1/1979 | Aro et al. | |
| 4,164,302 | A | 8/1979 | Gerdes | |
| 4,223,799 | A | 9/1980 | Eyster et al. | |
| 4,231,240 | A | 11/1980 | Fujita et al. | |
| 4,245,751 | A | 1/1981 | Neiman | |
| 4,280,346 | A | 7/1981 | Evans | |
| 4,280,347 | A | 7/1981 | Evans | |
| 4,294,376 | A | 10/1981 | Keller | |
| 4,299,102 | A | 11/1981 | Aro | |
| 4,342,208 | A | 8/1982 | Evans | |
| 4,376,492 | A | 3/1983 | Bartel et al. | |
| 4,453,388 | A | 6/1984 | Baker et al. | |
| 4,468,058 | A | 8/1984 | Haagen et al. | |
| 4,485,647 | A | 12/1984 | Matthews | |
| 4,527,406 | A | 7/1985 | Baker | |
| 4,579,244 | A | 4/1986 | Fukuta | |
| 4,592,218 | A | 6/1986 | Chechovsky et al. | |
| 4,676,390 | A | 6/1987 | Harris | |
| 4,690,292 | A | 9/1987 | Henning | |
| 4,706,841 | A | 11/1987 | Grajek | |
| 4,754,627 | A | 7/1988 | Butler, III | |
| 4,765,505 | A | 8/1988 | Harris | |
| 4,775,061 | A | 10/1988 | Coote | |
| 4,779,755 | A | 10/1988 | Harris | |
| 4,809,869 | A | 3/1989 | Cosgrove et al. | |
| 4,830,058 | A | 5/1989 | Harris | |
| 4,830,213 | A | 5/1989 | Sleder | |
| 4,881,597 | A | 11/1989 | Hensley | |
| 4,887,733 | A | 12/1989 | Harris | |
| 4,892,216 | A | 1/1990 | Scott | |
| 4,978,027 | A | 12/1990 | Larson | |
| 4,984,698 | A | 1/1991 | Stuckey | |
| 5,000,339 | A | 3/1991 | Wheat et al. | |
| 5,042,678 | A | 8/1991 | Munguia | |
| 5,108,001 | A | 4/1992 | Harris | |
| 5,110,003 | A | 5/1992 | Macwilliams | |
| 5,167,340 | A | 12/1992 | Shaw | |
| 5,171,439 | A | 12/1992 | Vakharia | |
| 5,183,173 | A * | 2/1993 | Heckman | B60K 15/0406 220/203.07 |
| 5,212,971 | A | 5/1993 | Yoon et al. | |
| 5,381,919 | A | 1/1995 | Griffin et al. | |
| 5,449,086 | A | 9/1995 | Harris | |
| 5,467,621 | A | 11/1995 | Gravino | |
| 5,520,300 | A | 5/1996 | Griffin | |
| 5,540,347 | A | 7/1996 | Griffin | |
| 5,638,975 | A | 6/1997 | Harris | |
| 5,732,841 | A | 3/1998 | Jocic et al. | |
| 5,791,507 | A | 8/1998 | Harris et al. | |
| 5,794,806 | A | 8/1998 | Harris et al. | |
| 5,904,057 | A | 5/1999 | Abney, III et al. | |
| 5,924,590 | A | 7/1999 | Jocic et al. | |
| 5,985,002 | A | 11/1999 | Grantham | |
| 5,992,669 | A | 11/1999 | Hagano et al. | |
| 5,992,672 | A | 11/1999 | Hagano et al. | |
| 6,056,140 | A | 5/2000 | Karl et al. | |
| 6,095,363 | A | 8/2000 | Harris et al. | |
| 6,109,467 | A | 8/2000 | Schniemann | |
| RE36,959 | E | 11/2000 | Griffin | |
| 6,193,093 | B1 | 2/2001 | Brunner | |
| 6,202,879 | B1 | 3/2001 | Gericke | |
| 6,202,901 | B1 | 3/2001 | Gerber et al. | |
| 6,220,064 | B1 | 4/2001 | Oddenino | |
| 6,230,918 | B1 | 5/2001 | Huynh et al. | |
| 6,231,106 | B1 | 5/2001 | Nagasaka | |
| 6,293,996 | B1 | 9/2001 | Grantham et al. | |
| RE37,776 | E | 7/2002 | Foltz | |
| 6,415,941 | B1 | 7/2002 | Huse | |
| 6,478,360 | B1 | 11/2002 | Reutter | |
| 6,562,110 | B2 | 5/2003 | Koros et al. | |
| 6,579,342 | B2 | 6/2003 | Wang et al. | |
| 6,585,802 | B2 | 7/2003 | Koros et al. | |
| 6,626,157 | B2 | 9/2003 | Perry | |
| 6,651,707 | B2 | 11/2003 | Zimmer et al. | |
| 6,685,045 | B1 | 2/2004 | Palvolgyi | |
| 6,688,146 | B2 | 2/2004 | Michels et al. | |
| 6,701,952 | B1 | 3/2004 | Ehrman et al. | |
| 6,705,267 | B1 | 3/2004 | Westerbeke, Jr. et al. | |
| 6,779,544 | B2 | 8/2004 | Devall | |
| 6,782,911 | B2 | 8/2004 | Decapua et al. | |
| 6,796,451 | B2 | 9/2004 | Harris | |
| 6,895,943 | B1 | 5/2005 | Taxon | |
| 6,935,527 | B1 | 8/2005 | Brock | |
| 6,942,124 | B2 | 9/2005 | Dehn et al. | |
| 6,953,496 | B2 | 10/2005 | Grantham et al. | |
| 6,981,532 | B2 | 1/2006 | Dehn et al. | |
| 7,624,889 | B2 | 12/2009 | Tharp et al. | |
| 2001/0052292 | A1 | 12/2001 | Ito | |
| 2003/0209574 | A1 | 11/2003 | Lin et al. | |
| 2005/0098160 | A1 | 5/2005 | Taxon | |
| 2007/0169524 | A1 * | 7/2007 | Tharp | B60K 15/0409 70/172 |

FOREIGN PATENT DOCUMENTS

| | | | |
|---|---|---|---|
| DE | 9205925 | U1 | 12/1992 |
| DE | 102005041096 | B4 | 12/2010 |
| EP | 0461852 | B1 | 12/1991 |
| EP | 1574381 | A2 | 9/2005 |
| EP | 1810864 | A1 | 7/2007 |
| EP | 2327581 | B1 | 2/2013 |
| FR | 1357064 | A | 4/1964 |
| GB | 1487489 | A | 9/1977 |
| KR | 200441792 | Y1 | 9/2008 |
| WO | 9015662 | A1 | 12/1990 |
| WO | 9503949 | A1 | 2/1995 |
| WO | 0020292 | A1 | 4/2000 |

* cited by examiner

CAP WITH KEY LOCK ASSEMBLY

CROSS-REFERENCE TO RELATED APPLICATIONS

The present application claims priority to U.S. Provisional Application No. 63/605,356, filed Dec. 1, 2023, the entire contents of which is incorporated by reference herein.

BACKGROUND

The present disclosure relates to caps for containers and, more particularly, to caps having a key lock assembly to selectively lock the cap on the container.

SUMMARY

The present disclosure may provide, in one independent aspect, a cap couplable to a container, the cap including a body engageable with the container and rotatable about an axis to couple or decouple the body from the container, a handle couplable to the body, and a key lock assembly operable to selectively couple the handle to the body for co-rotation. The key lock assembly includes a lift cam supported within the body and having a first cam surface, a clutch plate supported within the handle, the clutch plate having a second cam surface, the second cam surface being engageable with the first cam surface, and a key lock cylinder coupled for co-rotation with the lift cam, the key lock cylinder rotatably coupled to the handle and movable between an unlocked position where the handle is coupled to the body and a locked position where the handle is decoupled from the body. Rotation of the key lock cylinder towards the locked position rotates the lift cam so the first cam surface engages the second cam surface to axially displace the clutch plate to uncouple the handle to the body.

The present disclosure may provide, in another independent aspect, a cap couplable to a container, the cap including a body engageable with the container and rotatable about an axis to couple or decouple the body from the container, a handle couplable to the body, and a key lock assembly operable to selectively couple the handle to the body for co-rotation, the key lock assembly including a lift cam supported within the body, the lift cam having a first cam surface defining raised portions and lowered portions, a clutch plate supported within the handle on top of the lift cam, the clutch plate having a second cam surface defining corresponding raised and lowered portions that are engageable with the raised portions and lowered portions of the first cam surface, and a key lock cylinder coupled for co-rotation with the lift cam, the key lock cylinder rotatably coupled to the handle and movable between an unlocked position where the handle is coupled to the body and a locked position where the handle is decoupled from the body. Rotation of the key lock cylinder towards the locked position rotates the lift cam so the raised portions of the first cam surface engages the raised portions of the second cam surface to axially displace the clutch plate to uncouple the handle to the body.

The present disclosure may provide, in another independent aspect, a cap couplable to a container, the cap including a body engageable with the container and rotatable about an axis to couple or decouple the body from the container, a handle couplable to the body, an air intake filter supported within an internal cavity of the body, the air intake filter configured to restrict debris from entering the container, a filter cover coupled to the body to secure the air intake filter within the internal cavity of the body, and a key lock assembly operable to selectively couple the handle to the body for co-rotation, the key lock assembly including a lift cam supported within the body on top of the air intake filter, a clutch plate supported within the handle on top of the lift cam, a spring positioned between the handle and the clutch plate to urge the clutch plate into engagement with the lift cam, and a key lock cylinder coupled for co-rotation with the lift cam, the key lock cylinder rotatably coupled to the handle and movable between an unlocked position where the handle is coupled to the body and a locked position where the lift cam axially displaces the clutch plate to decouple the handle to the body the handle is decoupled from the body.

Other independent features and independent aspects of the disclosure may become apparent by consideration of the following detailed description and accompanying drawings.

Before any independent embodiments of the disclosure are explained in detail, it is to be understood that the disclosure is not limited in its application to the details of construction and the arrangement of components set forth in the following description or illustrated in the following drawings. The disclosure is capable of other independent embodiments and of being practiced or of being carried out in various ways. Also, it is to be understood that the phraseology and terminology used herein is for the purpose of description and should not be regarded as limiting.

DETAILED DESCRIPTION

Figure 1:
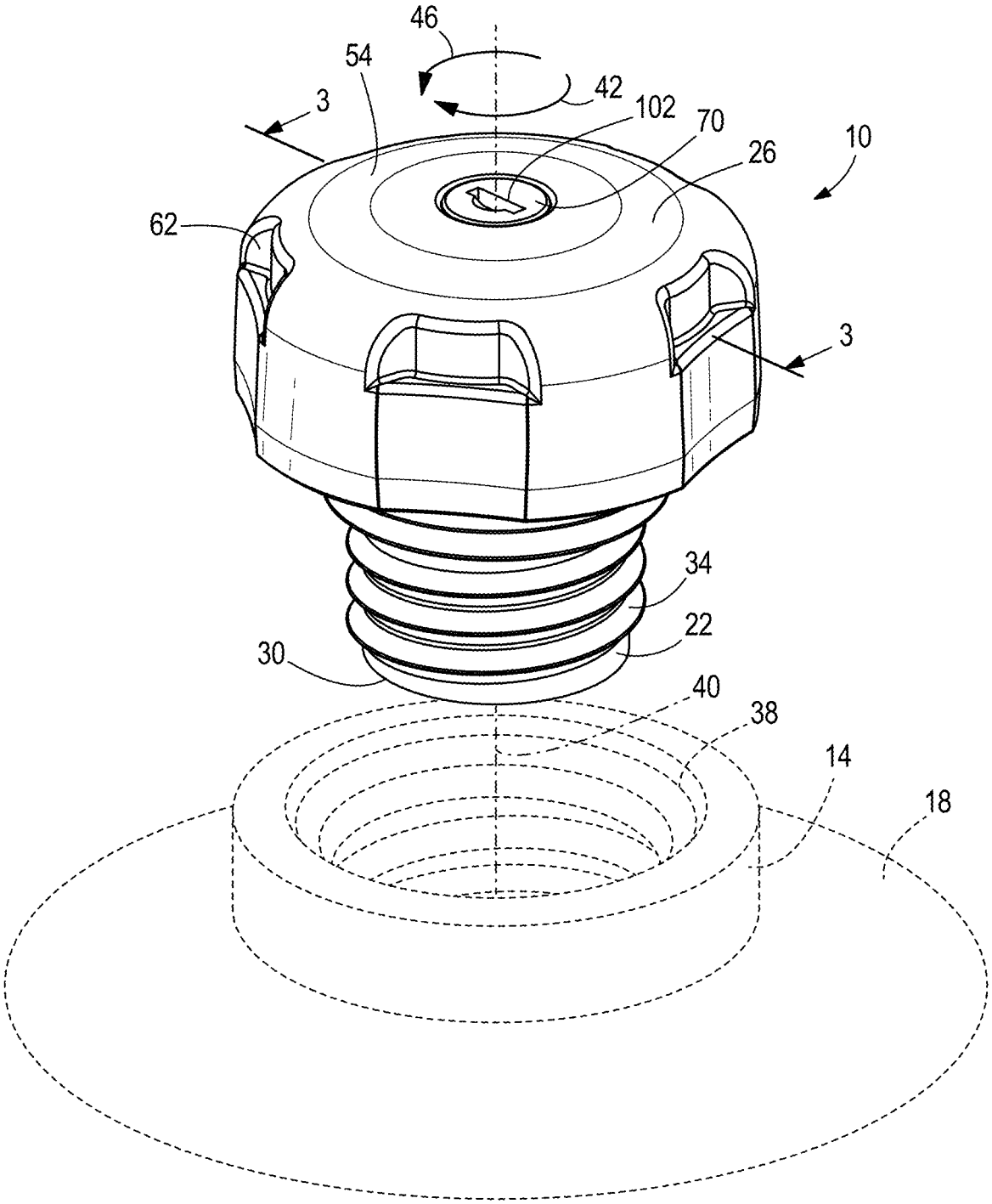
FIG. 1 is a perspective view illustrating a cap according to an embodiment of the disclosure.

FIG. 1 illustrates a cap 10 that is removably couplable to an opening or inlet 14 of a container 18. When positioned on the inlet 14, the illustrated cap 10 blocks the inlet 14 to enclose the contents of the container 18 while still allowing pressurized gasses to be vented from the container 18 under certain conditions. In some embodiments, the container 18 includes a fuel tank, such as a standalone fuel tank or a fuel tank incorporated into a vehicle or other powered machine. In other embodiments, the cap 10 can be used with any other container storing any other contents.

The illustrated cap 10 includes a body 22 (FIG. 2) and a handle 26 selectively coupled to the body 22. The body 22 has an annular wall 30 with external threads 34 engageable with internal threads 38 on the inlet 14 of the container 18 to couple the body 22 to the container 18. In an alternative construction (not shown), the body 22 may include internal threads engageable with external threads on the inlet 14. The body 22 is rotatable about an axis 40 in a tightening direction 42 and a loosening direction 46 to respectively couple and decouple the body 22 from the inlet 14.

Figure 2:
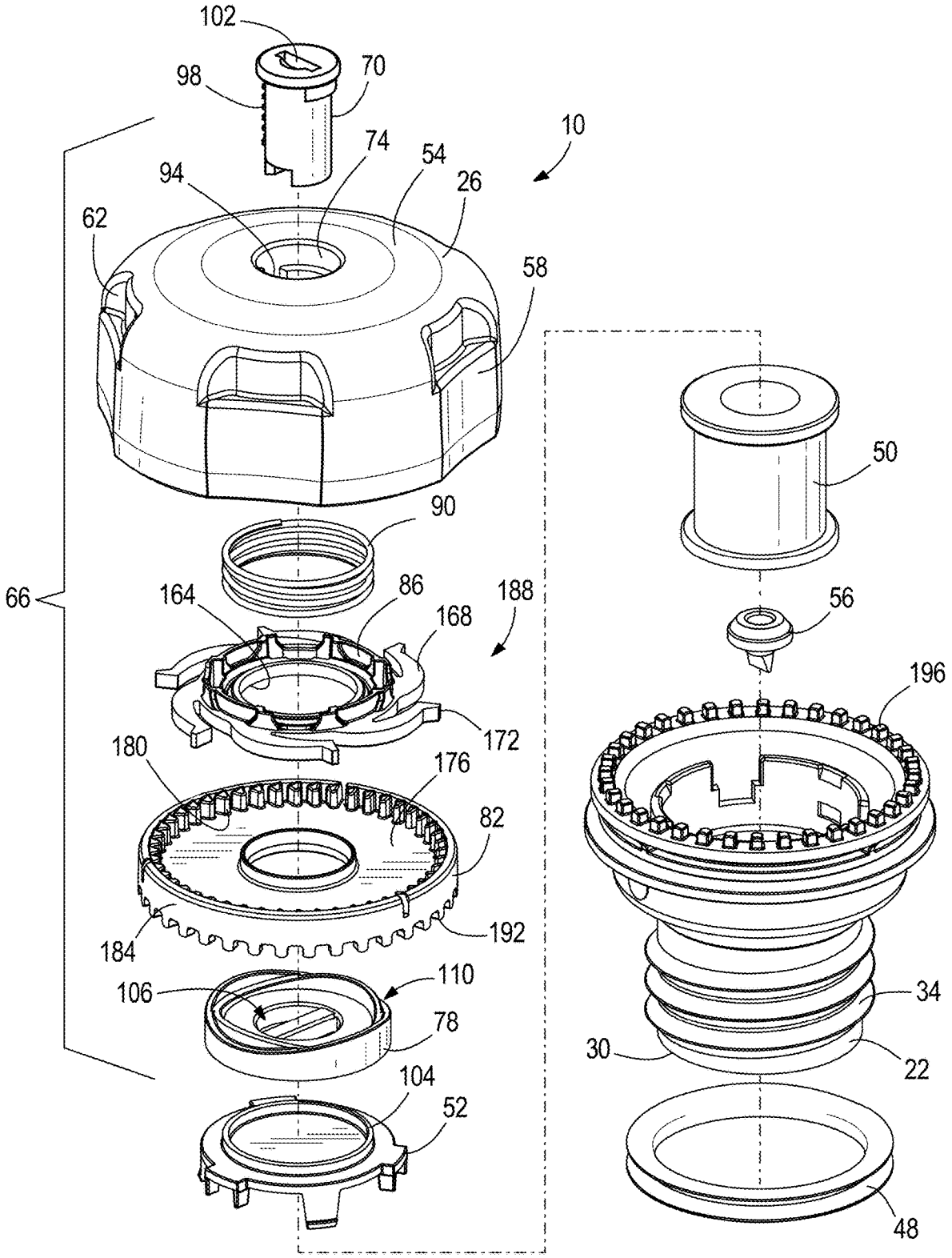
FIG. 2 is an exploded view of the cap of FIG. 1 illustrating a key lock assembly.

Now with reference to FIG. 2, the body 22 carries a gasket 48 (FIG. 2), which surrounds the annular wall 30 and engages an outer edge of the inlet 14 to create a substantially liquid and/or gas-tight seal between the body 22 and the inlet 14 when the body 22 is coupled to the inlet 14. The cap 10 further includes an air intake filter 50 positioned within an internal cavity of the body 22, a filter cover 52 coupled to the body to secure the air intake filter 50 within the internal cavity, and a valve 56 coupled to the body 22. The air intake filter 50 is configured to restrict debris (e.g., dirt, dust, or the like) from entering the container 18 when the cap 10 is coupled to the container 18. The valve 56 may be a combination valve that selectively allows pressure from the container to be released. In some embodiments, the air intake filter 50 may be omitted.

The handle 26 has a top side 54 and a circumferential side 58 extending downward from the top side 54. In the illustrated embodiment, the circumferential side 58 is provided with a plurality of ridges or undulations 62, which may enhance a user's ability to grip and rotate the handle 26 (e.g., when tightening or loosening the cap 10). The handle 26 is selectively coupled to the body 22 via a key lock assembly 66 (FIG. 2). As described in greater detail below, the key lock assembly 66 is operable to selectively couple the handle 26 and the body 22 for co-rotation and to selectively permit the handle 26 to rotate relative to the body 22.

Figure 3:
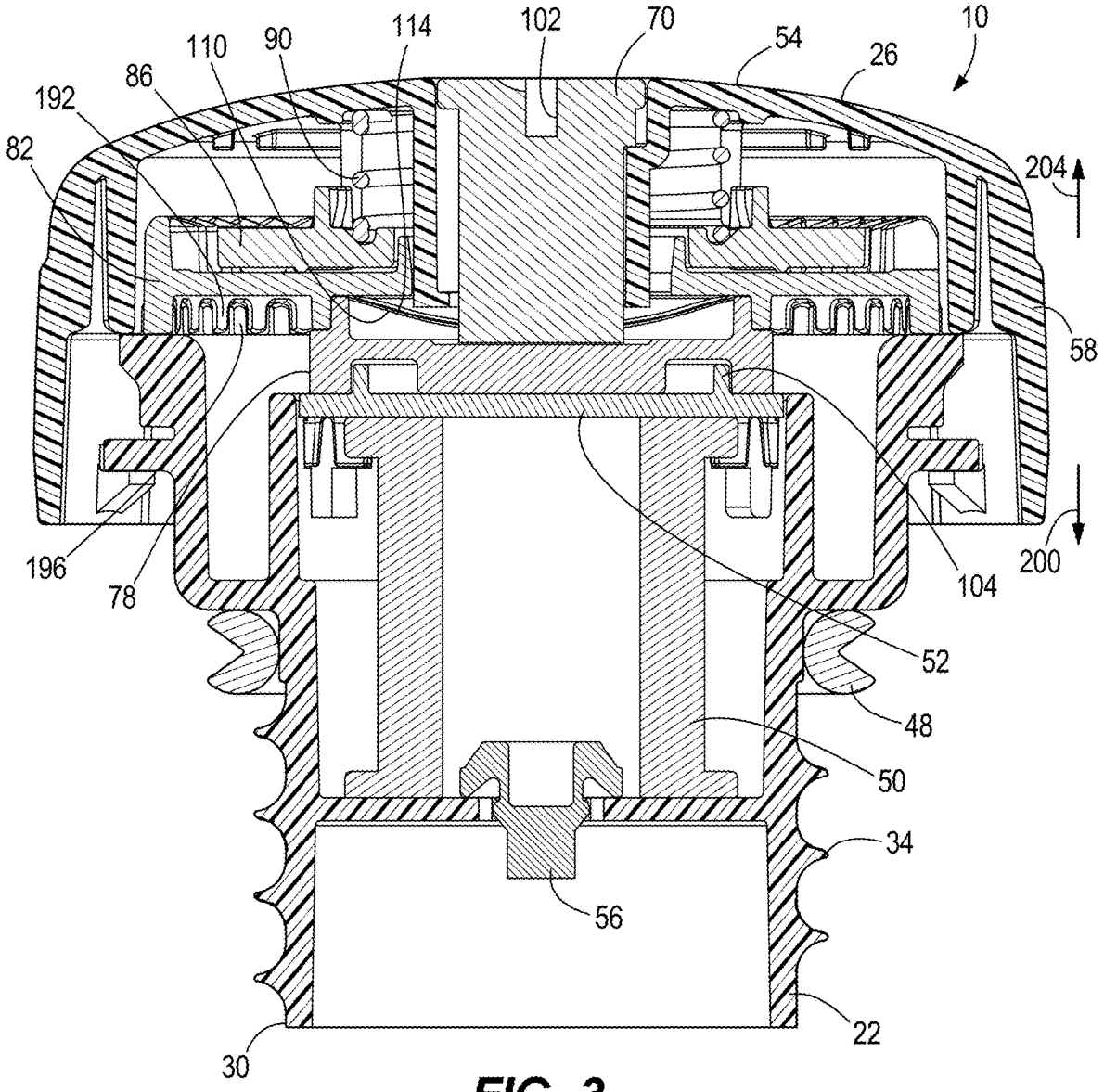
FIG. 3 is a cross-sectional view of the cap of FIG. 1 illustrating the key lock assembly in an unlocked position.
Figure 4:
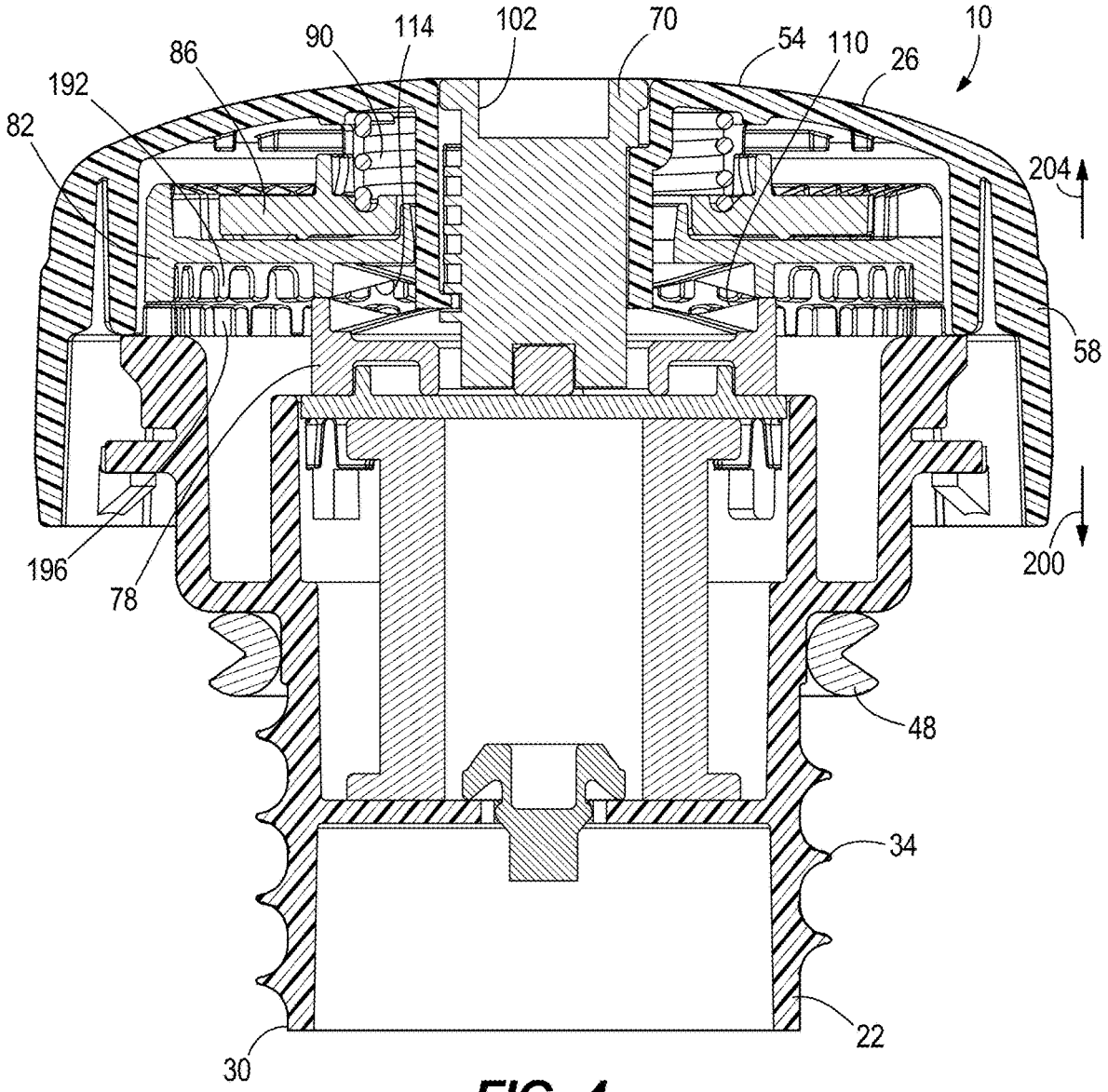
FIG. 4 is a cross-sectional view of the cap of FIG. 1 illustrating the key lock assembly in a locked position.

Referring to FIGS. 2-4, the illustrated key lock assembly 66 (FIG. 2) includes a key lock cylinder 70 positioned within an aperture 74 formed in the handle 26, a lift cam 78 supported within the body 22 and coupled for rotation with the key lock cylinder 70, a clutch plate 82 supported on top the lift cam 78, a ratchet 86 supported within the clutch plate 82, and a spring 90 positioned between the handle 26 and the ratchet 86 to urge the clutch plate 82 into engagement with the lift cam 78.

The key lock cylinder 70 is rotatably supported within the aperture 74, which includes slots 94 (FIG. 2) oriented for positioning drive features 98 (FIG. 2) of the key lock cylinder 70 in a locked position (FIG. 4) or an unlocked position (FIG. 3). For example, the handle 26 may include a counterbore step surface with stop ribs oriented with stop ribs on the key lock cylinder 70. A key receiving slot 102 is formed in a first end of the key lock cylinder 70 and is configured to receive a key (not shown) to rotate the key lock cylinder 70 between the unlocked position (FIG. 3) and locked position (FIG. 4).

The lift cam 78 includes a receiving structure 106 that receives a second end of the key lock cylinder 70 to couple the lift cam 78 for co-rotation with the key lock cylinder 70. In the illustrated embodiment, the lift cam 78 is supported on top of the filter cover 52 to secure the lift cam 78 within the body 22 of the cap 10. The filter cover 52 includes a support ridge 104 that engages a bottom surface of the lift cam 78 to restrict radial movement of the lift cam 78 within the body 22. In other embodiments, the lift cam 78 may be alternatively supported within the body 22.

Figure 5:
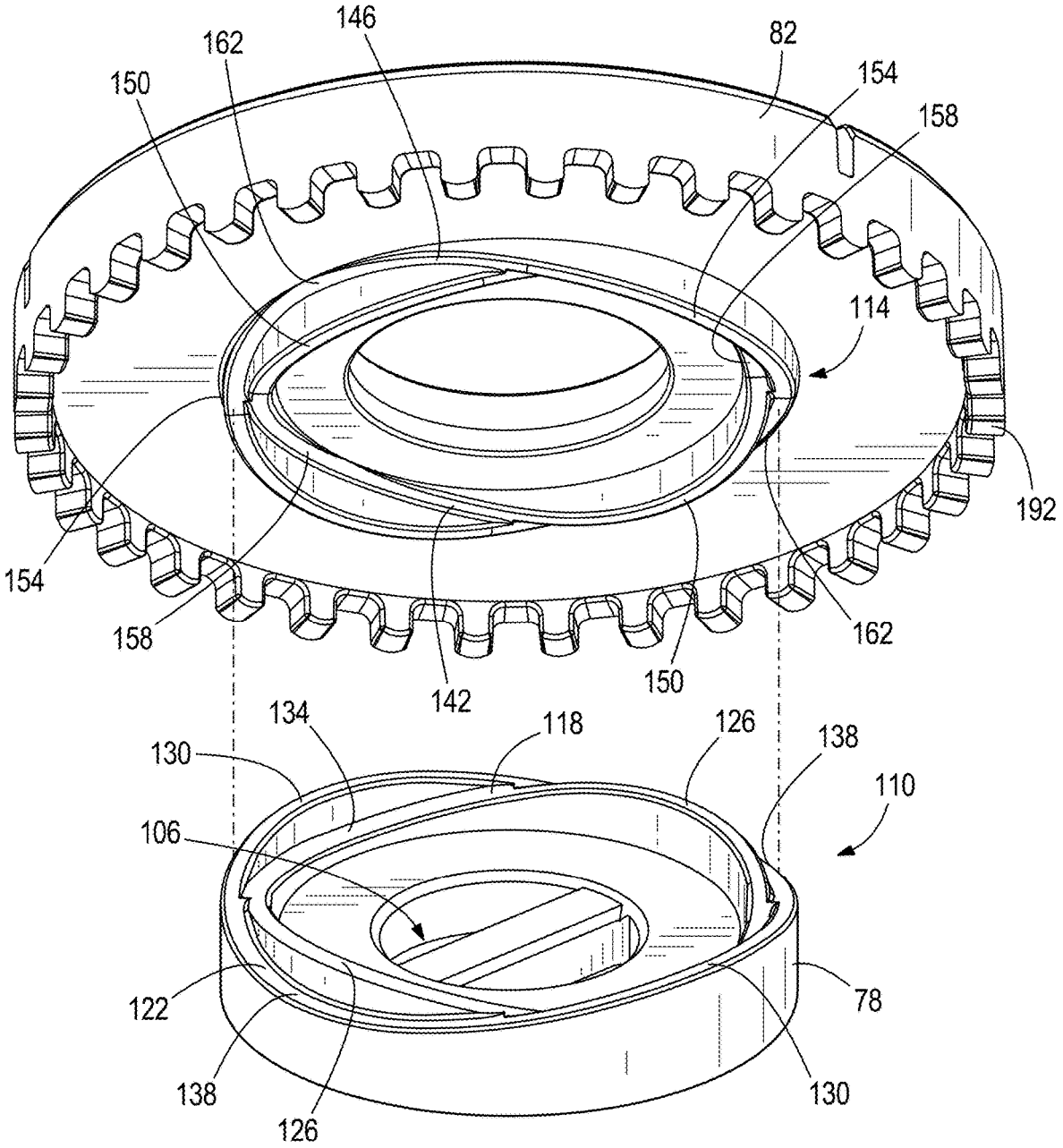
FIG. 5 is a perspective, exploded view of a lift cam and a clutch plate of the key lock assembly.

Now with reference to FIG. 5, the lift cam 78 includes a first cam surface 110 that engages a second cam surface 114 of the clutch plate 82. The first cam surface 110 includes a first inner cam surface 118 and a first outer cam surface 122 that is concentric with the first inner cam surface 118. The first inner cam surface 118 and the first outer cam surface 122 each include a contoured surface defining raised portions 126, 130 and lowered portions 134, 138. The first inner cam surface 118 and the first outer cam surface 122 are offset each other by 90 degrees such that the raised portions 126 of the first inner cam surface 118 are aligned with the lowered portions 138 of the first outer cam surface 122. In addition, the lowered portions 134 of the first inner cam surface 118 are aligned with the raised portions 130 of the first outer cam surface 122.

The second cam surface 114 includes a second inner cam surface 142 and a second outer cam surface 146 that is concentric with the second inner cam surface 142. The second inner cam surface 142 and the second outer cam surface 146 each include a contoured surface defining raised portions 150, 154 and lowered portions 158, 162. The second inner cam surface 142 and the second outer cam surface 146 are offset each other by 90 degrees such that the raised portions 150 of the second inner cam surface 142 are aligned with the lowered portions 162 of the second outer cam surface 146. In addition, the lowered portions 158 of the second inner cam surface 142 are aligned with the raised portions 154 of the second outer cam surface 146.

Figure 6:
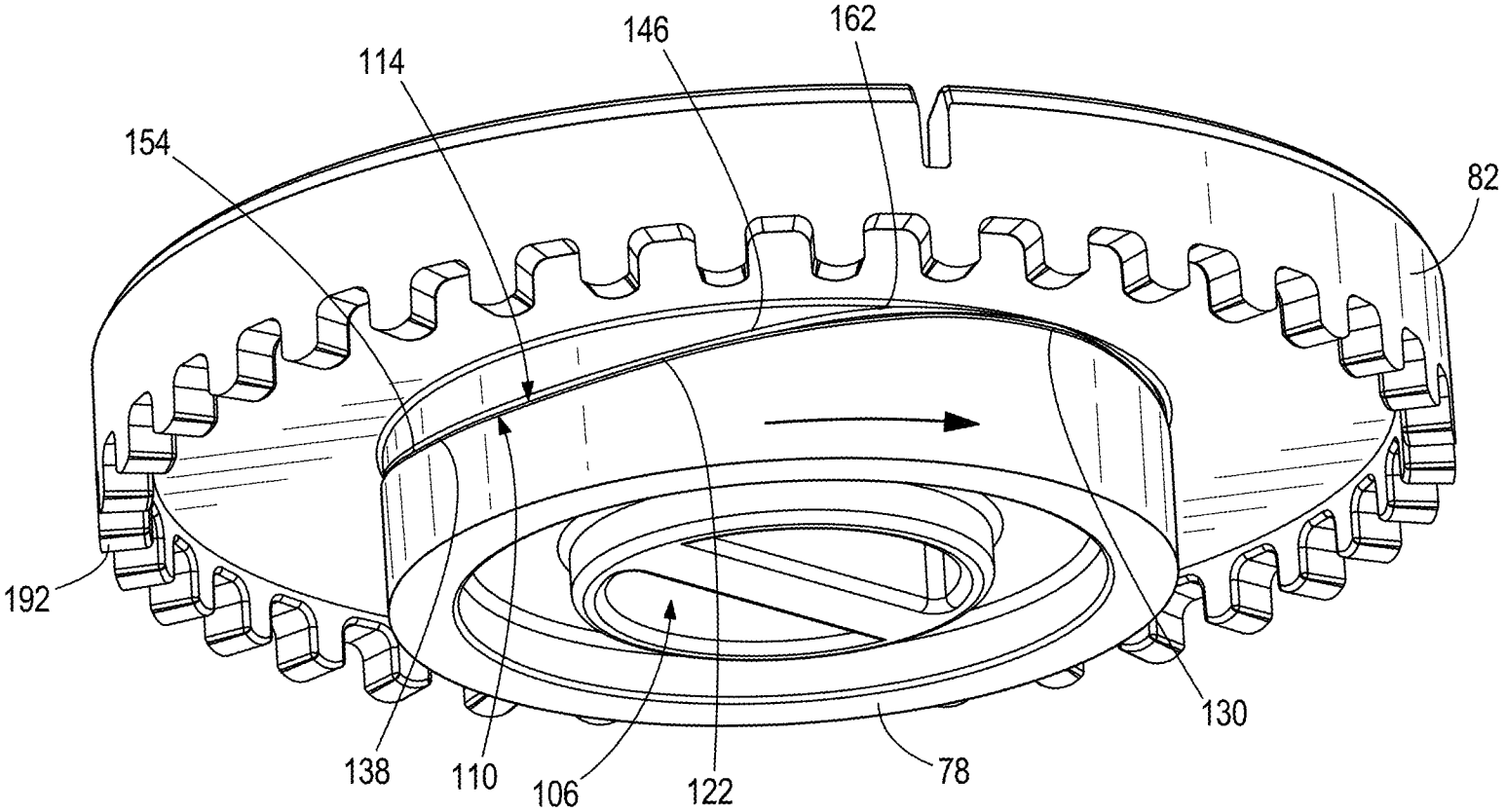
FIG. 6 is a perspective view of the lift cam and the clutch plate of the key lock assembly when the key lock assembly is in the unlocked position.

As described in more detail below, when the key lock cylinder 70 is rotated to an unlocked position (FIGS. 3 and 6) the raised portions 126, 130 of the first cam surface 110 are aligned with the lowered portions 158, 162 of the second cam surface 114. In other words, the first and second cam surfaces 110, 114 are mated together such that the first cam surface 110 is flush with the second cam surface 114. When the key lock cylinder 70 is rotated to an locked position (FIGS. 4 and 7), the raised portions 126, 130 of the first cam surface 110 are aligned with the raised portions 150, 154 of the second cam surface 114. In other words, rotation of the key lock cylinder 70 to the locked position causes movement of the first cam surface 110 relative to the second cam surface 114 to selectively move the clutch plate 82 upwards (e.g., against the bias of the spring 90).

Now with reference to FIG. 2, the ratchet 86 is fixed to the inside of the handle 26 (e.g., via a snap fit) and co-rotates with the handle 26. The ratchet 86 includes a central hub 164 and a plurality of flexible arms 168 extending outward from the hub 164. Each of the flexible arms 168 terminates with a pawl 172. The ratchet 86 is received in an annular recess 176 on top of the clutch plate 82. The flexible arms 168 press the pawls 172 into engagement with ratchet teeth 180 that extend radially inwardly from an outer annular wall 184 of the clutch plate 82. The ratchet 86 and the clutch plate 82 thus define a ratchet assembly 188 that limits the amount of torque that may be transferred from the ratchet 86 (and, therefore, from the handle 26) to the clutch plate 82.

Once a predetermined torque threshold is reached (based at least in part on the constructions of the pawls 172, the ratchet teeth 180, the flexible arms 168, etc.), the pawls 172 slide away from the ratchet teeth 180 while the arms 168 bend inward. In the illustrated embodiment, the ratchet assembly 188 only limits torque transfer in one rotational direction (e.g., the tightening direction 42). In some embodiments, the ratchet assembly 188 may be omitted, such that the handle 26 may be directly coupled to the clutch plate 82.

With reference to FIGS. 3 and 4, the clutch plate 82 further includes a first plurality of axially-extending teeth 192 that extend downwardly from a bottom side of the outer annular wall 184. The first plurality of teeth 192 is engageable with a second plurality of axially-extending teeth 196 that extend upwardly from a top side of the body 22. The clutch plate 82 is movable along the axis 40 to engage and disengage the teeth 192, 196 in response to rotation of the key lock cylinder 70 about the axis 40.

The clutch plate 82 is biased downwardly, in the direction of arrow 200, by the spring 90 such that the teeth 192, 196 are biased into engagement thereby coupling the clutch plate 82 and the body 22 for co-rotation when the key lock cylinder is in the unlocked position. In the illustrated embodiment, the spring 90 is a coil spring disposed between the ratchet 86 and an underside of the handle 26 (FIG. 2). The spring 90 thus bears against the ratchet 86, which in turn bears against the top side of the clutch plate 82 to urge the clutch plate 82 into engagement with the lift cam 78. In other embodiments (not shown), the spring 90 may be other biasing members such as magnets, a disc spring, or any other means for biasing the clutch plate 82 toward the body 22.

Rotating the key lock cylinder 70 causes the lift cam 78 to move the clutch plate in a second direction 204 corresponding to upward movement of the clutch plate 82 against the biasing force of the spring 90. In other words, the interaction between the first and second cam surfaces 110, 114 causes the clutch plate 82 to move in the second direction 204 so the teeth 192 on the clutch plate 82 are disengaged from the teeth 196 on the body 22 (FIG. 4). Thus, when the key lock cylinder 70 is in the locked position (FIG. 4), the teeth 192 of the clutch plate 82 are in a disengaged position, which restricts removal of the cap 10 from the container 18.

In operation, to close the container 18, a user inserts the body 22 of the cap 10 into the inlet 14 and grasps and rotates the handle 26 in the tightening direction 42 (FIGS. 1-2). In order to couple the cap 10 to the container 18, the key lock cylinder 70 must be positioned in the unlocked position (FIG. 3) so the cam surfaces 110, 114 are mated together. When the cam surfaces 110, 114 are mated, the teeth 192 of the clutch plate 82 are mated with the teeth 196 of the body 22. As such, torque is transferred from the handle 26, through the ratchet assembly 188 and to the body 22 via the engaged teeth 192, 196 (FIG. 3). The body 22 can thus be threaded onto the threads 38 of the inlet 14.

If torque applied to the handle 26 in the tightening direction 42 exceeds the torque threshold of the ratchet assembly 188, the arms 168 flex inwardly, and the pawls 172 ride over the associated ratchet teeth 180. As such, the handle 26 and the ratchet 86 rotate relative to the clutch plate 82 and the body 22, and the torque-transmitting connection between the handle 26 and the body 22 is at least momentarily disengaged. The ratchet assembly 188 may thus prevent over-tightening of the cap 10. In addition, when the pawls 172 ride over the ratchet teeth 180, the ratchet assembly 188 may provide audible and/or tactile feedback to the user that a sufficient level of torque (e.g., at or greater than a minimum retention torque) has been achieved.

Figure 7:
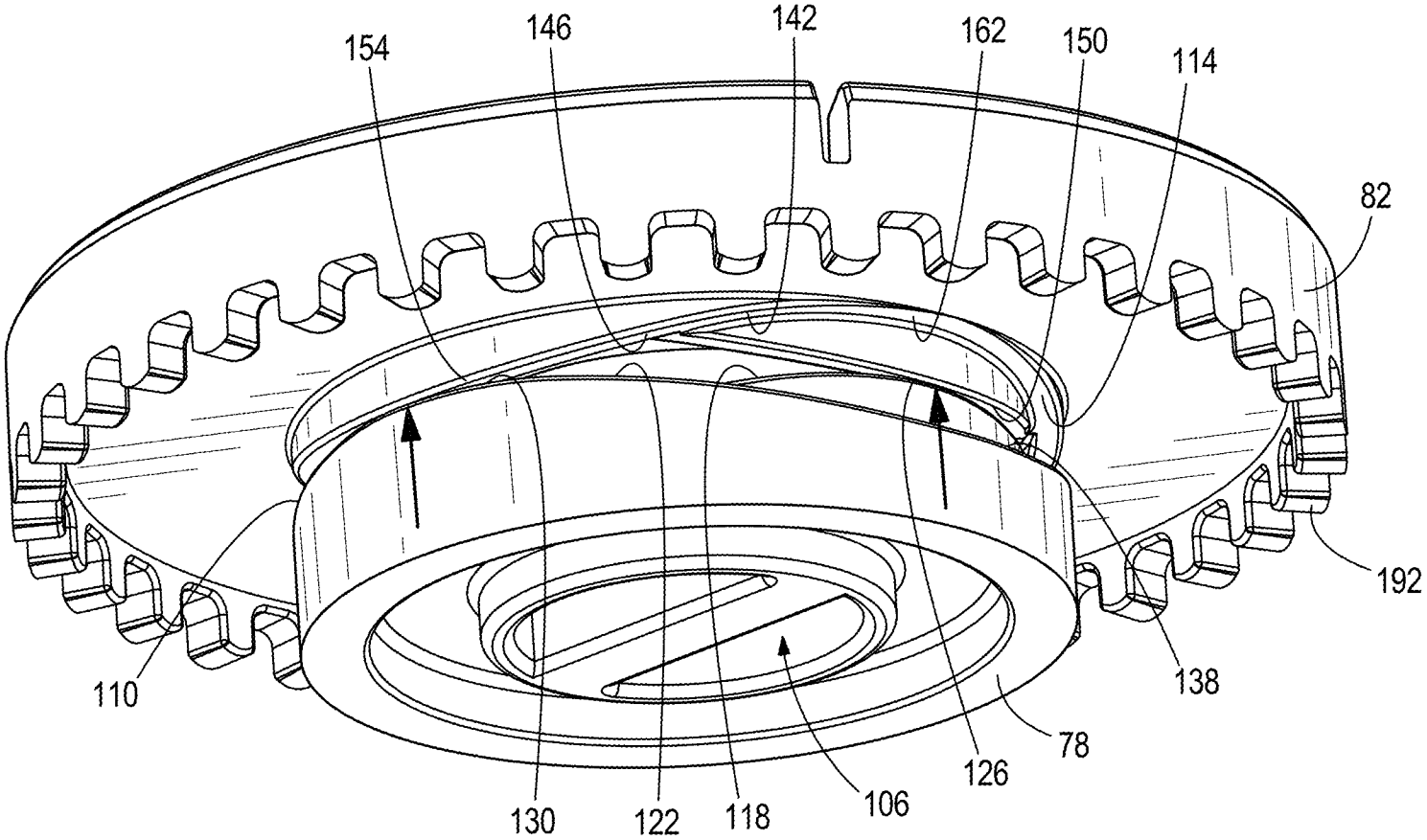
FIG. 7 is a perspective view of the lift cam and the clutch plate of the key lock assembly when the key lock assembly is in the locked position.

With the cap 10 coupled to the container 18, the operator may lock the cap 10 with the key lock assembly 66 to prevent unwanted removal of the cap 10 (e.g., by unauthorized users, prevent thief of fluid within the container 18, etc.). To lock the cap 10, the operator inserts a key (not shown) into the key receiving slot 102 of the key lock cylinder 70. As the operator rotations the key lock cylinder 70 to the locked position (FIG. 4), the positioning drive features 98 (FIG. 2) are guided within the slots 94 formed in the aperture 74 of the handle 26. The rotation of key lock cylinder 70 causes the lift cam 78 to rotation such that the first cam surface 110 rotates relative to the second cam surface 114 (FIGS. 4 and 7).

In the locked position, the raised portions 126, 130 of the first cam surface 110 are aligned with the raised portions 150, 154 of the second cam surface 114, which causes the clutch plate 82 to move upwards against the bias of the spring 90. When the clutch plate 82 moves upwards, the teeth 192 of the clutch plate 82 disengage from the teeth 196 of the body 22. Therefore, the handle 26 is uncoupled from the body 22 such that the handle 26 rotates relative to the body 22, which restricts removal of the cap 10 from the container 18. In some embodiments, very light contact at the tips of the mating teeth 192, 196 may occur to provide audible and/or tactile feedback to the user that the key lock cylinder 70 is in the locked position.

In order to uncouple the cap 10 from the container 18, the key lock cylinder 70 must be rotated to the unlocked position (FIG. 3). To unlock the cap 10, the operator inserts a key (not shown) into the key receiving slot 102 of the key lock cylinder 70. As the operator rotations the key lock cylinder 70 to the unlocked position (FIG. 3), the positioning drive features 98 (FIG. 2) are guided within the slots 94 formed in the aperture 74 of the handle 26. The rotation of key lock cylinder 70 causes the lift cam 78 to rotation such that the cam surfaces 110, 114 are mated together. When the cam surfaces 110, 114 are mated, the teeth 192 of the clutch plate 82 are mated with the teeth 196 of the body 22. As such, torque is transferred from the handle 26, through the ratchet assembly 188 and to the body 22 via the engaged teeth 192, 196 (FIG. 3). The body 22 can thus be unthreaded from the threads 38 of the inlet 14.

Although the disclosure has been described in detail with reference to certain preferred embodiments, variations and modifications exist within the scope and spirit of one or more independent aspects of the disclosure as described.

What is claimed is:

1. A cap couplable to a container, the cap comprising:

a body engageable with the container and rotatable about an axis to couple or decouple the body from the container;

a handle couplable to the body; and a key lock assembly operable to selectively couple the handle to the body for co-rotation, the key lock assembly including a lift cam supported within the body, the lift cam having a first cam surface, a clutch plate supported within the handle, the clutch plate having a second cam surface, the second cam surface being engageable with the first cam surface, and a key lock cylinder coupled for co-rotation with the lift cam, the key lock cylinder rotatably coupled to the handle and movable between an unlocked position where the handle is coupled to the body and a locked position where the handle is decoupled from the body, wherein rotation of the key lock cylinder towards the locked position rotates the lift cam so the first cam surface engages the second cam surface to axially displace the clutch plate to uncouple the handle to the body, and wherein a ratchet is supported within the clutch plate, the ratchet being rotatable relative to the clutch plate to limit torque transfer from the handle to the body in at least one rotational direction.

2. The cap of claim 1, wherein the first cam surface and the second cam surface each include a contoured surface defining raised portions and lowered portions, the raised portions of the first cam surface are aligned with the lowered portions of the second cam surface when the key lock cylinder is in the unlocked position, and the raised portions of the first cam surface are aligned with the raised portions of the second cam surface when the key lock cylinder is in the locked position.

3. The cap of claim 2, wherein the first cam surface and the second cam surface each include an inner cam surface and an outer cam surface that is concentric to the inner cam surface.

4. The cap of claim 1, wherein a spring is positioned between the handle and the clutch plate, and the spring is configured to urge the clutch plate downwards so the first cam surface engages the second cam surface.

5. The cap of claim 1, wherein in the ratchet includes a plurality of flexible arms extending radially outwardly from the ratchet, each of the plurality of flexible arms including a pawl engageable with a plurality of ratchet teeth on the clutch plate.

6. The cap of claim 1, wherein a first plurality of axially-extending teeth extends downwardly from a bottom side of an outer annular wall of the clutch plate, a second plurality of axially-extending teeth extend upwardly from a top side of the body, and the clutch plate is movable along the axis to selectively engage and disengage the first and second pluralities of axially-extending teeth in response to rotation of the key lock cylinder about the axis.

7. The cap of claim 1, further comprising an air intake filter supported within an internal cavity of the body, the air intake filter configured to restrict debris from entering the container, and a filter cover coupled to the body to secure the air intake filter within the internal cavity of the body.

8. The cap of claim 7, wherein the filter cover includes a support ridge that engages a bottom surface of the lift cam to restrict radial movement of the lift cam within the body.

9. A cap couplable to a container, the cap comprising:

a body engageable with the container and rotatable about an axis to couple or decouple the body from the container;

a handle couplable to the body; and a key lock assembly operable to selectively couple the handle to the body for co-rotation, the key lock assembly including a lift cam supported within the body, the lift cam having a first cam surface defining raised portions and lowered portions, a clutch plate supported within the handle on top of the lift cam, the clutch plate having a second cam surface defining corresponding raised and lowered portions that are engageable with the raised portions and lowered portions of the first cam surface, and a key lock cylinder coupled for co-rotation with the lift cam, the key lock cylinder rotatably coupled to the handle and movable between an unlocked position where the handle is coupled to the body and a locked position where the handle is decoupled from the body, wherein rotation of the key lock cylinder towards the locked position rotates the lift cam so the raised portions of the first cam surface engages the raised portions of the second cam surface to axially displace the clutch plate to uncouple the handle to the body.

10. The cap of claim 9, wherein the raised portions of the first cam surface are aligned with the lowered portions of the second cam surface when the key lock cylinder is in the unlocked position.

11. The cap of claim 9, wherein the first cam surface and the second cam surface each include an inner cam surface and an outer cam surface that is concentric to the inner cam surface.

12. The cap of claim 9, wherein a spring is positioned between the handle and the clutch plate, and the spring is configured to urge the clutch plate downwards so the first cam surface engages the second cam surface.

13. The cap of claim 9, wherein a first plurality of axially-extending teeth extend downwardly from a bottom side of an outer annular wall of the clutch plate, a second plurality of axially-extending teeth extend upwardly from a top side of the body, and the clutch plate is movable along the axis to selectively engage and disengage the first and second pluralities of axially-extending teeth in response to rotation of the key lock cylinder about the axis.

14. The cap of claim 9, further comprising an air intake filter supported within an internal cavity of the body, the air intake filter configured to restrict debris from entering the container, and a filter cover coupled to the body to secure the air intake filter within the internal cavity of the body.

15. The cap of claim 14, wherein the filter cover includes a support ridge that engages a bottom surface of the lift cam to restrict radial movement of the lift cam within the body.

16. A cap couplable to a container, the cap comprising:

a body engageable with the container and rotatable about an axis to couple or decouple the body from the container;

a handle couplable to the body;

an air intake filter supported within an internal cavity of the body, the air intake filter configured to restrict debris from entering the container;

a filter cover coupled to the body to secure the air intake filter within the internal cavity of the body; and a key lock assembly operable to selectively couple the handle to the body for co-rotation, the key lock assembly including a lift cam supported within the body on top of the air intake filter, a clutch plate supported within the handle on top of the lift cam, a spring positioned between the handle and the clutch plate to urge the clutch plate into engagement with the lift cam, and a key lock cylinder coupled for co-rotation with the lift cam, the key lock cylinder rotatably coupled to the handle and movable between an unlocked position where the handle is coupled to the body and a locked position where the lift cam axially displaces the clutch plate to decouple the handle to the body the handle is decoupled from the body.

17. The cap of claim 16, wherein the lift cam includes a first cam surface, the clutch plate includes a second cam surface, the first cam surface and the second cam surface each include a contoured surface defining raised portions and lowered portions, the raised portions of the first cam surface are aligned with the lowered portions of the second cam surface when the key lock cylinder is in the unlocked position, and the raised portions of the first cam surface are aligned with the raised portions of the second cam surface when the key lock cylinder is in the locked position.

18. The cap of claim 17, wherein the first cam surface and the second cam surface each include an inner cam surface and an outer cam surface that is concentric to the inner cam surface.

19. The cap of claim 16, wherein a first plurality of axially-extending teeth extend downwardly from a bottom side of an outer annular wall of the clutch plate, a second plurality of axially-extending teeth extend upwardly from a top side of the body, and the clutch plate is movable along the axis to selectively engage and disengage the first and second plurality of axially-extending teeth in response to rotation of the key lock cylinder about an axis.

* * * * *